United States Patent [19]

Bunk et al.

[11] Patent Number: 4,659,318

[45] Date of Patent: Apr. 21, 1987

[54] METHOD TO INTRODUCE A FILL GAS MIXTURE INTO AN ELECTRIC LIGHT BULB, PARTICULARLY HALOGEN INCANDESCENT LAMP

[75] Inventors: Axel Bunk; Gottfried Eichelbrönner, both of Munich; Rainer Haake, Berlin; Karl Stadler, Fidelschlag; Manfred Gaugel, Fürstenfeldbruck, all of Fed. Rep. of Germany

[73] Assignee: Patent Treuhand -Gesellschaft für elektrische Glühlampen m.b.H., Munich, Fed. Rep. of Germany

[21] Appl. No.: 801,553

[22] Filed: Nov. 25, 1985

[30] Foreign Application Priority Data

Nov. 28, 1984 [DE] Fed. Rep. of Germany ..... 3443382

[51] Int. Cl.[4] ..... H01J 9/395

[52] U.S. Cl. ..... 445/54; 445/73; 445/57

[58] Field of Search ..... 445/53, 56, 57, 73, 445/54

[56] References Cited

U.S. PATENT DOCUMENTS 2,527,185 10/1950 Geyer ..... 445/53 X
3,788,725 1/1974 Yannopoulos ..... 445/53
4,005,324 1/1977 Dolenga et al. ..... 445/53 X

FOREIGN PATENT DOCUMENTS 139738 10/1980 Japan ..... 445/53

*Primary Examiner*—Kenneth J. Ramsey
*Attorney, Agent, or Firm*—Frishauf, Holtz, Goodman & Woodward

[57] ABSTRACT

To eliminate the necessity for supervising the composition of a fill being introduced to a halogen incandescent lamp bulb, so that the proportion of halogen containing additive and inert gas will be at a predetermined ratio, by spectroscropic and other similar means, the halogen containing additive (8) is placed, in solid or liquid phase, in a mixing vessel at a temperature ($T_1$) which is in excess of a temperature ($T_2$) which is necessary to result in the vapor pressure to enrich the inert gas at the predetermined quantity. The inert gas is conducted into the vessel and thereby excessively enriched. The excessively enriched inert gas is passed through a condenser, the temperature of which is accurately controlled to the temperature ($T_2$) to thereby condense out the excess halogen additive, so that the mixture then will have the desired relationship of halogen containing additive and inert gas; this mixture is then being filled into the lamp. If the halogen is present in form of a carbon containing compound, or a hydrocarbon compound, it is conducted first over a cracking unit (15), for example quartz granules heated to 900° C., to remove any carbon. Composite fill mixtures of, preferably, the same inert gas such as argon, with different halogen additives, such as bromine or iodine, can be mixed in a blender (17) of constant flow throughput.

20 Claims, 2 Drawing Figures

METHOD TO INTRODUCE A FILL GAS MIXTURE INTO AN ELECTRIC LIGHT BULB, PARTICULARLY HALOGEN INCANDESCENT LAMP

Reference to related publication: U.S. Pat. No. 3,788,725, Yannopoulos and Pebler.

The present invention relates to a method to introduce a fill gas mixture into the bulb of an electric lamp, and more particularly into the bulb of a halogen incandescent lamp, and especially to a method to accurately control the relative proportion of the components of the fill for the bulb.

BACKGROUND

Various types of electric lamps, and particularly halogen incandescent lamps, include a fill gas which has in inert component and an additive. Halogen incandescent lamps have an inert base component and a halogen contaning additive. The quantity of the halogen containing additive in the inert gas is controlled by the vapor pressure.

In a method which has been proposed to enrich a gas with an additive, appropriate dosing of the base gas is obtained by providing the additive in solid or liquid form in a vessel or container which is then brought to a predetermined temperature, causing a certain vapor pressure to arise. This vapor pressure is the one required to enirch the base gas, flowing with a predetermined speed through the vessel, with a predetermined quantity of the additive.

The referenced U.S. Pat. No. 3,788,725 describes a process to fill a halogen incandescent lamp by dosing the halogen concentration of the fill gas by conducting an inert gas through a carbon-bromine, $CBr_4$ granulate. The container which receives the $CBr_4$ must be brought to that temperature at which the $CBr_4$ generates that vapor pressure which is required in order to enrich the inert gas with the appropriate quantity of halogen additive for operation of the lamp.

The type of dosing described in the patent is difficult to control, and the quantity of halogen additive in the inert gas is subject to variations. The mixing container, thus, is connected to an infrared (IR) gas analyzer which continuously measures the halogen concentration in the mixed fill gas and, if the halogen concentration is not at the desired level, it either changes the temperature of the $CBr_4$ or the flow speed of the inert gas.

THE INVENTION

It is an object to provide a method to introduce a fill gas into an electric lamp, and especially to provide for a proper relationship of inert gas to halogen additive which results in precise dosing of the halogen containing additive so that continuous control of the gas composition is no longer required.

Briefly, in accordance with the invention, the halogen containing additive is provided in a vessel in solid or liquid phase, at a temperature $T_1$ which is higher than the temperature $T_2$ which is necessary to generate the vapor pressure to enrich the inert gas with the appropriate quantity of halogen containing additive, that is, the appropriate quantity for lamp operation. The inert gas is conducted through the vessel and will become enriched with the halogen containing additive. The so-enriched inert gas is then condensed in a condenser to the temperature $T_2$, so that excess halogen containing additive is condensed out. The result will be a properly enriched fill gas which is filled into the lamp.

Preferably, the temperature $T_1$ is room temperature. Thus, the vessel does not require special heating or cooling systems. The fill gas mixture at the temperature $T_1$ then can also be transported in non-insulating tubes or pipes and halogen containing additives will not condense out under those conditions.

The temperature $T_2$ depends on the vapor pressure and the desired quantity of the halogen containing additive which is used.

Inert gases which are suitable are taken from the group of noble gases argon, crypton, and xenon. Nitrogen, also, can be used as an inert gas. Mixtures of two or more of the foregoing gases may be used.

The halide additive suitably utilizes all halogen containing compounds in which the vapor pressure, required for adding the halide additive, is at a temperature which is below room temperature. Halogen-carbon and halogen-hydrocarbon compounds are preferred since the vapor pressure of these compounds is usually at a temperature below room temperature. Typical substances, depending on the eventual use in the lamp and the application of the lamp are: $CCl_4$, $CBr_4$, $CHCl_2Br$, $CHBr_3$ and $CH_2Br_2$.

If elementary bromine is used as the halogen additive, special materials must be used for seals, ducts and piping and the like, since bromine, particularly in the vapor phase, is highly aggressive. The materials must be capable of resisting the bromine.

Hydrogen halides are gaseous at room temperature. In order to permit use of these compounds, by dosing by control of vapor pressure, the temperature $T_1$ must be below the boiling temperature of the respective hydrogen halide. If HBr is used, $T_1 < -67°$ C.

Carbon which is present in many of the compounds referred to is undesirable for use in the lamp and may attack lamp components. Carbon in the lamp fill leads to carburation of the filament which, then, will become brittle. It is, thus, desirable to crack the fill gas mixture prior to filling it into the lamp. For cracking, the mixture is guided over an adsorption substance, heated to about 900° C. Quartz granulate, glass granules, tungsten, or molybdenum pellets are suitable to precipitate the carbon.

If the fill gas should contain a further halogen containing component, for example to increaes the lifetime of the lamp, it is desirable to use a gas blender. The further halogen containing component may, just as the original fill gas mixture, comprise an inert gas with a halogen containing additive and is derived either from a dosing arrangement as described above or from a compressed gas bottle.

The blender has two separate inputs over which the gas mixtures are applied with equal pressure. A fixed diaphragm is provided which generates a predetermined fixed differential pressure, to result, at a constant temperature, in a constant gas flow. If a constant gas stream is fed through one diaphragm, the first gas stream will decrease by precisely the value of the second gas stream. By making one of the diaphragms variable, for example that controlling the second gas stream, it is possible to accurately control the mixing relationship and change the mixing relationship as the diaphragm opening is changed.

If the gas to be added contains carbon, for example just like the first fill mixture, then it is desirable to carry out the previously described cracking step only after both gas components are mixed together.

DRAWINGS

The drawings illustrate apparatus to introduce a fill gas mixture into an electric lamp and show in:

FIG. 1, an arrangement to dose the components of a fill gas mixture; and

FIG. 2, an arrangement to mix two fill gas mixtures with cracking of the mixture to remove carbon and to fill a lamp with the mixture.

DETAILED DESCRIPTION

Figure 1:
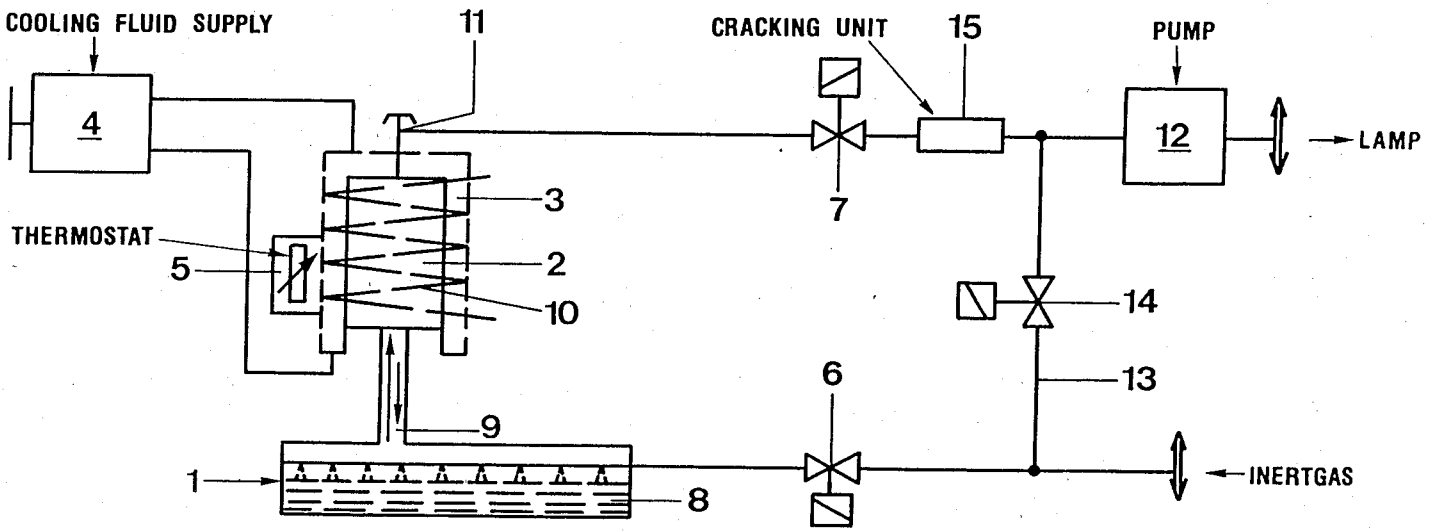

Referring to FIG. 1: The apparatus to mix an inert gas with a halogen additive is shown schematically and includes a mixing vessel 1 connected to a condenser 2, and having an evaporator 3. A cooling element 4 and a control unit 5 is provided. Magnetic valves 6, 7 control flow.

A supply bottle—not shown—supplies inert gas, for example, argon, through magnetic valve 6 to the vessel 1. A check valve may be interposed in the connection line to prevent feedback to the supply bottle. Check valves and the like have been omitted from the drawing, since their use is well known and can be connected in accordance with appropriate engineering standards. The mixing vessel 1 retains a halogen containing compound, for example dibromine-methane. The dibromine-methane is present in liquid form at the temperature $T_1$, for example room temperature. The dibromine-methane is shown as the liquid 8 and, at room temperature, a certain vapor pressure will result.

The inert gas will become enriched in the mixing vessel 1 by the vapor of the halogen containing additive. The gas mixture, in saturated condition, will be conducted over connecting pipe 9 into the condenser 2.

The condenser 2 is cooled by the evaporator 3 which surrounds the condenser 2 in form of a cooling jacket. At the upper side of the evaporator 3, cooling fluid, derived from the cooling unit 4, is injected, evaporated in the interior of the jacket 3 and returned to the cooling unit 4 by suction from the lower side of the evaporator 3. A pressure sensor, such as a manometer, can be coupled to the mixing vessel 1 in order to indicate the pressure of the inert gas which is introduced into the pressure vessel to form the mixture and thus provide an indication of the concentration of the mixture.

Two manometers may be coupled to the space of the mixing vessel 1. One of them is a standard indicator; the other is coupled to a limit switch, for example, an inductive coupling. The measuring system is coupled to the output of the mixing apparatus behind the magnetic valve 7 and measures the pressure in the line to a pump 12.

A branch line for fill gas 13, with a valve 14 interposed, can be connected directly from the inert gas input to the pump 12 which is connected to the lamp. Upon closing valves 6 and 7 and opening valve 14, the inert gas can be conducted into the lamp for flushing or purging the lamp prior to filling. This is a step usually carried out to insure that the interior of the lamp bulb, prior to introducing the fill, will be free from contaminants.

The halide additive used in most of the fill gas mixtures contains carbon, which is detrimental upon operation of the lamp. In a particularly suitable embodiment for introducing a fill gas mixture into the electric lamp, a cracking unit 15 is provided prior to introducing the fill gas into the lamp, positioned preferably in advance of the pump 12. The cracking unit 15 or cracking system, in the example shown, is formed by a quartz tube filled with quartz granules. The quartz tube is surrounded by a heating jacket and a heat insulator. The quartz granules are heated by the heating jacket to about 900° C. Carbon in the fill gas will be precipitated on the quartz and the lamp will thus be filled with a bromine-hydrogen compound free from carbon.

A heater element 10 and a thermal sensor which is coupled to a thermostat 5 control the temperature in the condenser 2.

The temperature set in the condenser 2 causes excess dibromine-methane to precipitate on the walls of the condenser 2. The mixture is so distributed in the condenser 2 that the appropriate temperature of all portions of the mixture is reliably reached, so that the mixture is brought through and through to the required temperature. The condensate flows back by gravity into the mixing vessel 1. The fill gas mixture is removed from the condenser 2 by a stub connector 11 and is connected through the valve 7 and the cracking unit 15 to the pump 12 to fill a lamp (not shown).

Figure 2:
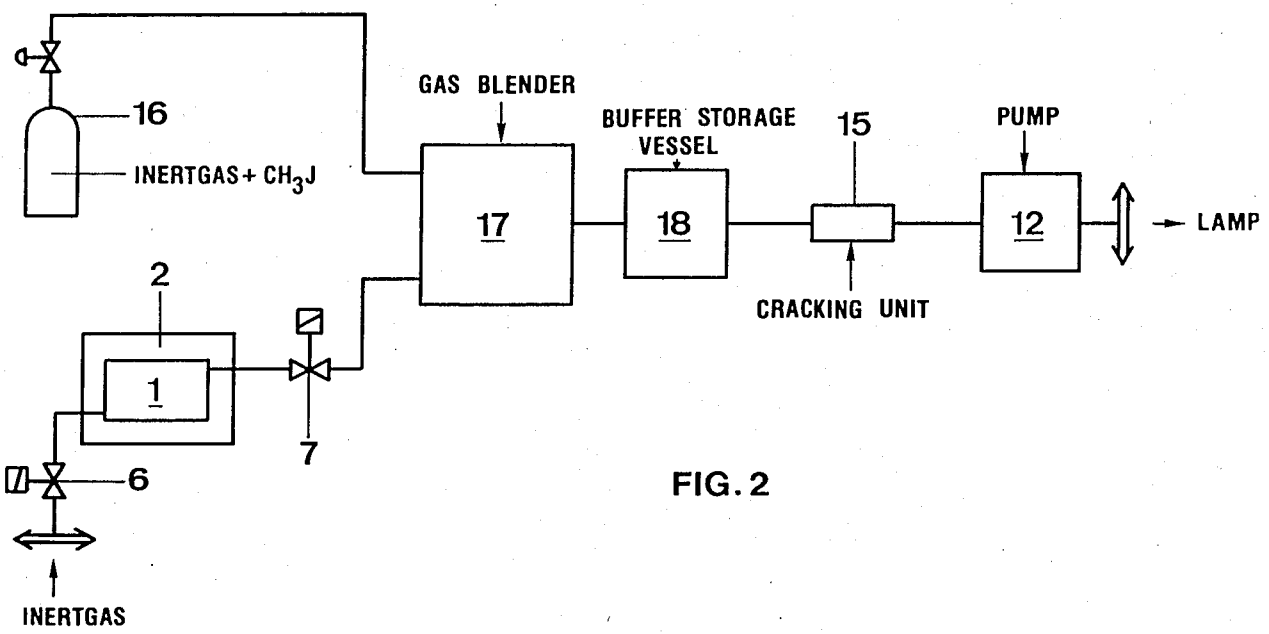

Embodiment of FIG. 2: Some electric lamps utilize a fill gas containing a plurality of gas mixtures, e.g. an iodinemethane and an argon-dibromine-methane-inert mixture. The iodinemethane, for better handling, is added to an individual inert gas. The inert gas preferably is the same for both gas mixtures, in the example again argon. The argon-iodinemethane mixture can be derived from a separate pressurized supply bottle 16 or, similar to the argon-dibromine-methane mixing arrangement described in FIG. 1, is generated by the controlled vapor pressure method, with condensation under controlled temperature conditions, as previously described.

Both inert-halogen mixed gases are mixed together in a gas blender 17. The gas blender receives the inert gas-and-iodinemethane mixture from the bottle 16 through a controlled valve and the inert gas-dibromine-methane mixture from valve 7 (FIG. 1). The gas blender 17 is so arranged that the mixing relationship for the final composite fill gas can be controlled so that the desired dibromine-methane-iodinemethane concentration can be obtained.

The dibromine-methane concentration, as well as the mixing relationship of both fill gases, can be controlled and thus the method permits—within limits of the system—generation of fill gas of any desired dibromine-methane and iodinemethane concentration.

Gas blenders, similar to gas blender 17, operate at constant gas flow or gas throughput. To fill the lamp, a larger quantity of fill gas mixture must be provided for a very short period of time. It is, thus, possible, that the quantity of fill gas delivered by the gas blender 17, for example 1 liter/minute, may not be sufficient to fill a plurality of lamps at the same time, for example five lamps which require about 400 $cm^3$. Since the filling steps are intermittent, a buffer storage vessel 18 is connected to the gas blender 17 and in advance of the cracking unit 15. The cracking unit 15 is introduced in advance of the pump 12 to precipitate carbon from the mixed fill gas, that is, both from the iodine as well as from the bromine halide additives.

The output from the pump 12 is shown directed to a lamp (not shown) as well as to a general conduit by the double arrow, schematically representing the arrangement permitting filling of a plurality of lamps at the same time.

We claim:

1. Method to introduce a fill gas mixture into a bulb of an electric lamp, particularly a halogen incandescent lamp, wherein the fill comprises an inert gas and a halogen containing additive, present in a predetermined quantity necessary for lamp operation, utilizing the step of dosing the quantity of the halogen containing additive by controlling the vapor pressure thereof, characterized, in accordance with the invention, by the steps of mixing inert gas and halogen containing additive by providing the halogen containing additive in a vessel (1) in a non-gaseous form, at a first temperature ($T_1$) which is higher than a second temperature, which second temperature ($T_2$) results in a vapor pressure which enriches the inert gas with said predetermined quantity of halogen containing additive, and conducting the inert gas through the vessel (1), thereby enriching the inert gas with the halogen containing additive in excess of the predetermined quantity of halogen containing additive, to thereby provide a mixture of halogen containing additive—excess enriched inert gas; and processing said mixture to provide therein the predetermined quantity of halogen containing additive to result in a properly dosed or proportioned mixture by condensing the excess enriched inert gas in a condenser (2) to said second temperature ($T_2$), to condense out excess halogen containing additive and thereby to obtain the desired inert gas-halogen additive mixture having said predetermined quantity of halogen containing additive therein;

and filling the so-obtained desired inert gas-halogen additive mixture into the lamp.

2. Method according to claim 1, wherein the first temperature ($T_1$) is approximately room temperature.

3. Method according to claim 1, wherein the inert gas comprises a noble gas, or nitrogen gas, or a mixture of said gases formed by the noble gas or nitrogen.

4. Method according to claim 1, wherein the first temperature ($T_1$) is approximately room temperature;

and wherein the halogen containing additive comprises a halogen containing substance in which the vapor pressure necessary for dosing the inert gas with said predetermined quantity is less than room temperature ($T_1$).

5. Method according to claim 4, wherein the halogen containing additive comprises a carbon halogen compound.

6. Method according to claim 4, wherein the halogen containing additive comprises a halogen containing hydrocarbon compound.

7. Method according to claim 5, including the step of cracking the mixture of the desired inert gas-halogen additive prior to filling the mixture into the lamp.

8. Method according to claim 6, including the step of cracking the mixture of the desired inert gas-halogen additive prior to filling the mixture into the lamp.

9. Method according to claim 8, wherein said step of cracking the mixture comprises conducting the mixture over an absorption substance heated to approximately about 900° C.

10. Method according to claim 9, wherein the absorption substance comprises quartz granulate, glass granules, tungsten pellets, molybdenum pellets.

11. Method according to claim 1, further comprising the step of adding to the inert gas-halogen additive mixture a further gas mixture in a predetermined quantity.

12. Method according to claim 11, wherein the step of adding a further gas mixture to the inert gas-halogen additive mixture comprises the step of conducting the further gas mixture and the inert gas-halogen additive mixture to a gas blender (17).

13. Method according to claim 11, wherein the further gas mixture comprises a halogen containing carbon compound, or a halogen containing hydrogen compound, or a halogen containing hydrocarbon compound.

14. Method according to claim 11, wherein the halogen containing additive comprises a halogen carbon compound, or a halogen containing hydrocarbon compound;

wherein the further gas mixture includes a halogen-carbon compound or a halogen containing hydrocarbon compound;

and including the step of cracking the composite mixture of said inert gas and halogen additive mixture and the further mixture prior to filling the composite mixture into the lamp.

15. Method according to claim 14, wherein said step of cracking the mixture comprises conducting the mixture over an absorption substance heated to approximately about 900° C.

16. Method according to claim 15, wherein the absorption substance comprises quartz granulate, glass granules, tungsten pellets, molybdenum pellets.

17. Method according to claim 1, wherein the step of condensing the inert gas in the condenser comprises controlling the temperature of the condenser to have said second temperature ($T_2$) to thereby control the vapor pressure of the halogen containing additive and hence the quantity of halogen containing additive present in said mixture.

18. Apparatus to introduce a fill gas mixture into an electric lamp bulb, particularly a halogen incandescent lamp, wherein the fill comprises an inert gas, and a halogen containing additive present in a predetermined quantity necessary for lamp operation, comprising a mixing vessel (1), retaining a halogen containing additive compound in non-gaseous form, a a first temperature ($T_1$) which is higher than a second temperature, which second temperature ($T_2$) results in a vapor pressure which enriches inert gas with said predetermined quantity of halogen containing additive;

means (6) for conducting the inert gas into said vessel (1) to thereby enrich the inert gas with evaporating halide additive at a quantity which is in excess of said predetermined quantity of halogen containing additive;

a condenser (2) and means (9) for conducting inert gas enriched by the halogen containing additive into the condenser;

means (3, 4, 5, 10) for controlling the temperature of the condenser to said second temperature ($T_2$) to condense excess halogen containing additive and obtain only the desired quantity of halogen additive in the inert gas mixture;

means for recycling condensed halogen containing additive to said mixing vessel (1);

and means (7, 12) for filling the lamp with the mixture of inert gas and halogen containing additive at said predetermined quantity of halogen containing additive, connected to and coupled to an outlet (11) of said condenser.

19. Apparatus according to claim 18, further comprising means (16) for supplying a further mixture of a further inert gas and a further halogen containing additive;

and a blender (17) having a constant flow quantity throughput connected to receive said inert gas-halogen additive mixture with said predetermined quantity of halogen additive and said further mixture, and providing a composite fill mixture, said composite fill mixture being conducted from said blender to said lamp filling means (12).

20. Apparatus according to claim 18, further comprising a cracking unit (15) coupled between the evaporator and said lamp filling means (12) for removing carbon or carbon compound from the mixture of inert gas and halogen additive.

* * * * *